US008573277B2

(12) United States Patent
Fueki

(10) Patent No.: US 8,573,277 B2
(45) Date of Patent: Nov. 5, 2013

(54) COATING FILM TRANSFER TOOL

(75) Inventor: Kazui Fueki, Tokyo (JP)

(73) Assignee: Plus Corporation, Tokyo (JP)

( * ) Notice: Subject to any disclaimer, the term of this patent is extended or adjusted under 35 U.S.C. 154(b) by 231 days.

(21) Appl. No.: 13/024,998

(22) Filed: Feb. 10, 2011

(65) Prior Publication Data

US 2011/0198037 A1 Aug. 18, 2011

(30) Foreign Application Priority Data

Feb. 12, 2010 (JP) ..... 2010029025

(51) Int. Cl.
*B65C 9/04* (2006.01)

(52) U.S. Cl.
USPC ..... 156/538; 156/577

(58) Field of Classification Search
USPC ..... 156/538, 577
IPC ..... B65C 9/04
See application file for complete search history.

(56) References Cited

U.S. PATENT DOCUMENTS

| | | | | |
|---|---|---|---|---|
| 6,500,259 | B1 * | 12/2002 | Tamai et al. | 118/76 |
| 6,599,363 | B2 * | 7/2003 | Narita | 118/76 |
| 6,730,186 | B2 * | 5/2004 | Takahashi | 156/238 |
| 6,830,089 | B1 * | 12/2004 | Tamai et al. | 156/577 |
| 7,275,578 | B2 * | 10/2007 | Mitsui et al. | 156/523 |
| 2008/0083487 | A1 * | 4/2008 | Moss et al. | 156/250 |
| 2008/0283182 | A1 * | 11/2008 | Allen et al. | 156/238 |

* cited by examiner

*Primary Examiner* — Philip Tucker
*Assistant Examiner* — Shawn F Hogan
(74) *Attorney, Agent, or Firm* — The Marbury Law Group, PLLC

(57) ABSTRACT

There is provided a coating film transfer tool with a reduced number of components and a high degree of design freedom, including a feed spool, a transfer head, a take-up spool, a transfer portion case that holds the feed spool, the transfer head and the take-up spool, a slip member that pivotally supports the feed spool and is loosely fitted in the transfer portion case, a feed-side gear securely fitted on the slip member in a position lying between the feed spool and the slip member, and a take-up-side gear that rotates together with the take-up spool. In the coating film transfer tool a rotation of the feed spool is transmitted to the take-up spool by the gears. The coating film transfer tool further includes a load adjusting means and a rotational speed adjusting means.

2 Claims, 6 Drawing Sheets

COATING FILM TRANSFER TOOL

CROSS-REFERENCE TO RELATED APPLICATION

This application is based upon and claims the benefit of priority under 35 USC 119 to Japanese Application No. 2010-29025 filed on Feb. 12, 2010, the entire disclosure of which, including the description, claims, drawings and abstract thereof, is hereby incorporated herein by reference.

TECHNICAL FIELD

The present invention relates to a coating film transfer tool for press transferring a coating film of a correction tape or a glue tape.

BACKGROUND

Coating film transfer tools for transferring a coating film of a correction tape or a glue tape to a transfer-receiving surface are now indispensable as stationery. In general, a coating film transfer tool includes a transfer tape made up of a coating film and a base tape, a feed spool around which an unused transfer tape is wound, a transfer head with which the transfer tape is pressed against a sheet of paper or the like, a take-up spool which takes up only the base tape from which a coating film has been transferred to a transfer-receiving object and a rotation transmitting means for transmitting a rotation of the feed spool to the take-up spool.

In a coating film transfer tool of the type, in case flexing is caused in a transfer tape, the transfer of a coating film may not be implemented properly. Because of this, a tension needs to be applied to the transfer tape at all times so that the transfer tape is kept tensioned. Consequently, rotational speeds of a take-up spool and a feed spool are adjusted so that the rotational speed of the take-up spool is faster than the rotational speed of the feed spool. However, when an amount of the transfer tape wound around the feed spool is decreased whereas an amount of a base tape wound around the take-up spool is increased, an amount of the base tape to be wound around the take-up spool every time the take-up spool rotates one full rotation is increased. Because of this, a difference between the feed amount and the take-up amount that is caused by the difference in rotational speed becomes large, and the transfer of the coating film may be difficult. Therefore, to deal with this, a rotational speed adjusting means is provided in the coating film transfer tool which causes the feed spool to slip so that the whole rotation of the feed spool is not transmitted to the take-up spool.

In the coating film transfer tool, the slipping amount of the feed spool by the rotational speed adjusting means changes from the start of using where the residual amount of unused tape is large towards the end of using where the residual amount of unused tape is small. Therefore, a load necessary to feed the unused transfer tape is increased towards the end of using the coating film transfer tool. Consequently, a load adjusting means may be provided from time to time for adjusting the load necessary to feed the transfer tape so that the load is maintained constant.

When the rotational speed adjusting means and the load adjusting means are provided in the coating film transfer tool, however, the number of components of the coating film transfer tool is increased, leading to a problem that the production costs are increased and the assemblage of components becomes difficult. To cope with this, JP-A-2009-166439 (Patent Document 1) proposes a load adjusting means in which an elastic arm is provided on a feed spool, and by this elastic arm being loosely fitted in a circular groove in a case, a slip torque is generated between the elastic arm and a wall surface of the circular groove. Namely, in this proposal, compared with a case where a member is provided separately as a load adjusting means, the number of components can be reduced by causing the feed spool and the case to function as the load adjusting means.

In addition, Patent Document 1 also proposes a configuration in which a circular groove is formed in a feed-side gear which transmits the rotation of the feed spool to a take-up spool, and an arm of a clutch member which doubles as a rotational shaft of the feed spool is loosely fitted in the circular groove in the feed-side gear so that a rotational speed adjusting means is made up of the feed-side gear and the clutch member. Namely, in this proposal, the number of components can be reduced by causing the feed-side gear to double as the rotational speed adjusting means.

SUMMARY OF THE INVENTION

In the invention described in Patent Document 1, by providing the load adjusting means and the rotational speed adjusting means, the load necessary to feed the transfer tape can be maintained substantially constant from the start of using towards the end of using the coating film transfer tool. In addition, the number of components can be reduced by causing the existing components such as the feed spool and the feed-side gear to double as the load adjusting means and the rotational speed adjusting means. With the invention of Patent Document 1, however, the production cost of the feed spool is increased due to the elastic arm being formed in the feed spool. In addition, in order to cause the feed spool to work as the load adjusting means, the feed spool has to be loosely fitted in the circular groove in the case, which leads to a problem that the degree of freedom in design with respect to the positional relationship between the feed spool and the case is reduced.

The invention has been made in view of the problems inherent in the related art, and an object thereof is to provide a coating film transfer tool which can reduce the number of components while having a load adjusting means and a rotational speed adjusting means and which has a high degree of freedom in design.

According to a first aspect of the invention, there is provided a coating film transfer tool comprising a feed spool around which an unused transfer tape is wound, a transfer head from which the transfer tape is suspended and which pressure transfers a coating film on the transfer tape suspended therefrom to a transfer-receiving object by pressing the coating film thereagainst, a take-up spool around which the transfer tape from which the coating film has already been transferred to the transfer-receiving object is wound, a transfer portion case which holds members, a slip member pivotally supporting the feed spool and adapted to be loosely fitted in the transfer portion case, a feed-side gear fittingly attached to the slip member in a position lying between the feed spool and the slip member and a take-up-side gear rotating together with the take-up spool, for transmitting a rotation of the feed spool to the take-up spool by the gears, wherein the transfer portion case and the slip member function as a load adjusting means, and the slip member and the feed-side gear function as a rotational speed adjusting means.

According to a second aspect of the invention, there is provided a coating film transfer tool as set forth in the first aspect of the invention, wherein the slip member has a shaft portion to which the feed spool is pivotally attached, an arm portion including an arm base portion formed in proximity to one end of the shaft portion and a plurality of arms which project outwards from the arm base portion, and a large diameter portion which is positioned at a boundary portion between the shaft portion and the arm base portion and of which a shaft diameter is formed larger than that of the shaft portion, and wherein the feed-side gear is a disc-shaped gearwheel in which teeth are formed along a circumferential edge and an opening is formed in a central portion as a fitting portion and has a plurality of abutment projections formed on an inner circumferential edge of the fitting portion for abutment with the large diameter portion of the slip member and an elastic opening which is provided as a circumferentially extending cutout in proximity to the position where the abutment projections are formed.

According to a third aspect of the invention, there is provided a coating film transfer tool as set forth in the first aspect of the invention, comprising further a main body case and a refill which is detachably accommodated within the main body case, wherein the transfer portion case functions as a case for the refill, wherein the refill incorporates the feed spool, the transfer head, the take-up spool, the slip member and the feed-side gear, and wherein the refill includes the load adjusting means and the rotational speed adjusting means.

According to the invention, the coating film transfer tool can be provided which can reduces the number of components while having the load adjusting means and the rotational speed adjusting means and which has a high degree of freedom in design.

DESCRIPTION OF PREFERRED EMBODIMENTS

Figure 1:
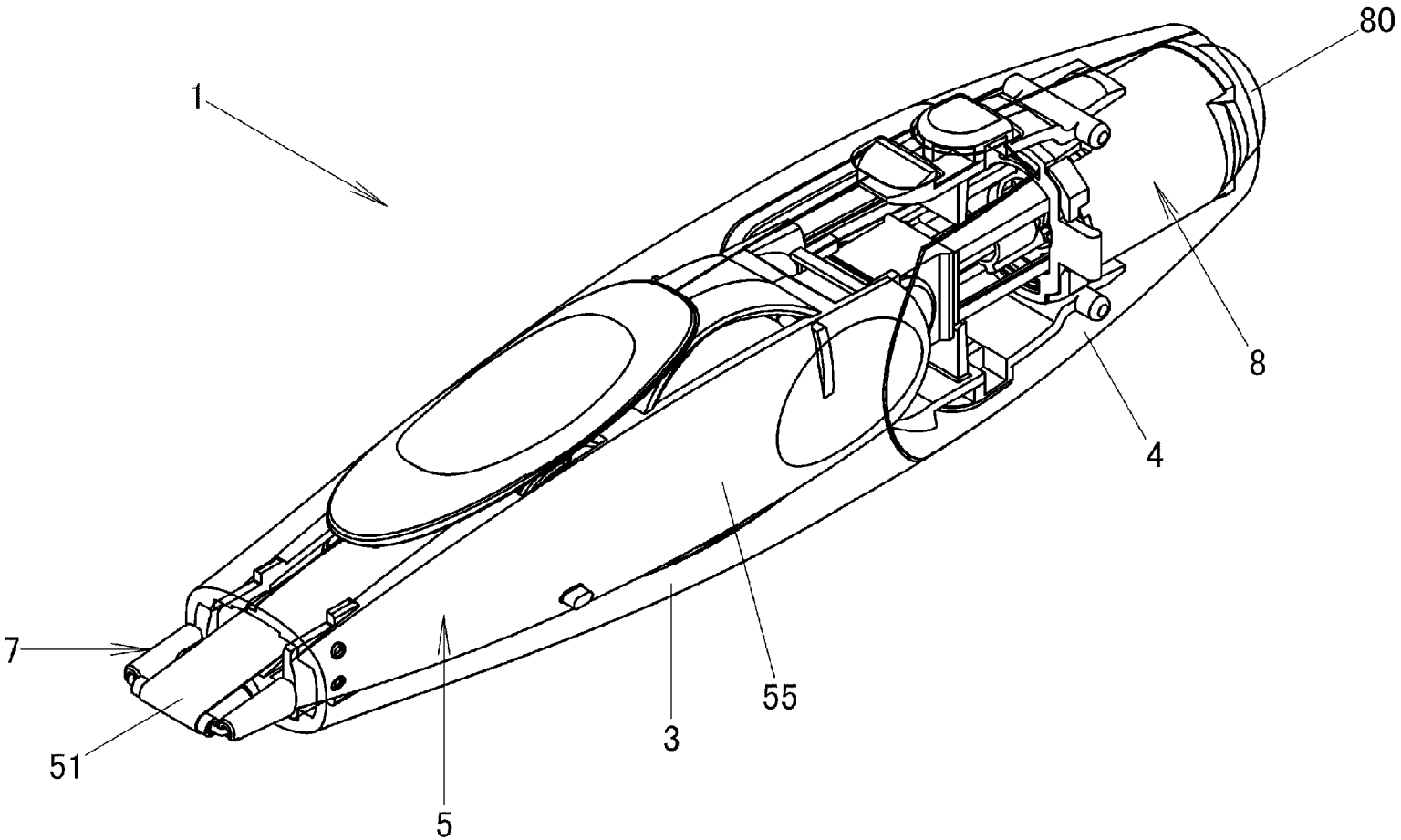
FIG. 1 is a perspective view showing an external appearance of a coating film transfer tool according to an embodiment of the invention when in a useable state.
Figure 2:
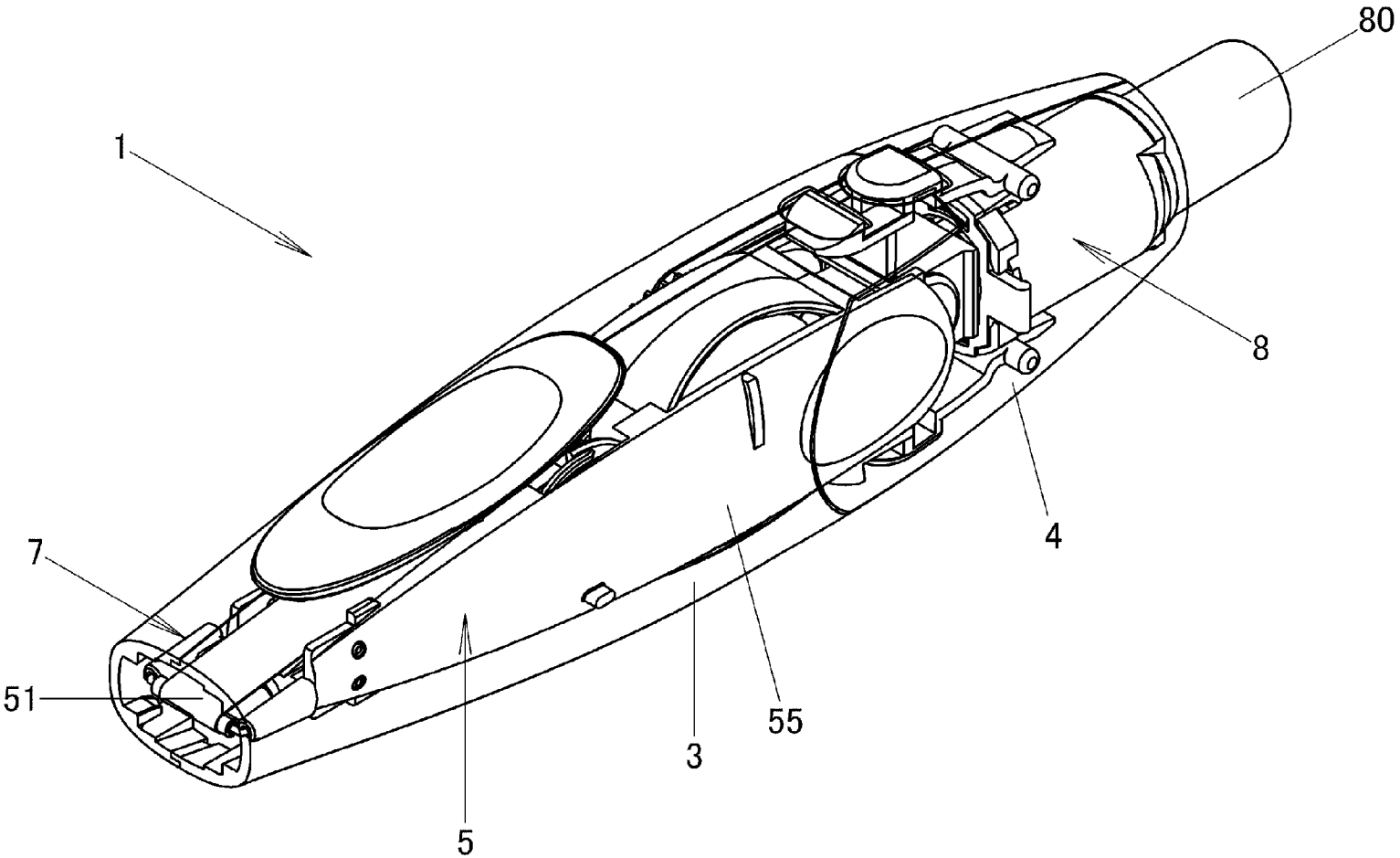
FIG. 2 is a perspective view showing an external appearance of the coating film transfer tool when in an unusable state.

Hereinafter, a coating film transfer tool 1 according to an embodiment of the invention will be described in detail by reference to the accompanying drawings. The coating film transfer tool 1 of the embodiment is an apparatus for pressure transferring a coating film of a transfer tape 51 which adheres to a base tape of the transfer tape 51 on to a transfer-receiving object such as a sheet of paper by causing a transfer head 7 to slide over the transfer-receiving object while pressing the transfer head 7 thereagainst. This coating film transfer tool 1 includes a refill 5 which is detachably installed in a main body case thereof so as to be replaced with a fresh refill 5. In addition, this coating film transfer tool 1 includes a knock mechanism 8, so that the transfer head 7 is allowed to freely appear from or disappear into the main body case by operating the knock mechanism 8.

The main body case of the coating film transfer tool 1 is made up of a front case 3 which detachably accommodates the refill 5 and a rear case 4 which is detachably attached to the front case 3. A front opening is formed in the front case 3 at a front end thereof so that the transfer head 7 is allowed to project therefrom, and a rear opening is formed at a rear end so that the refill 5 is loaded or unloaded therefrom.

The rear case 4 is a member which accommodates the knock mechanism 8, and an opening is formed in the rear case 4 at a front end thereof so as to correspond to the rear opening of the front case. A space, which allows constituent components to be accommodated within the main body case, is formed when the rear case 4 is attached to the front case 3. In addition, a through hole is formed in the rear case 4 at a rear end thereof so that a knock knob 80 is allowed to project therefrom, and the knock knob 80 for operating the knock mechanism 8 is provided.

The knock mechanism 8 is a mechanism in which the refill 5 moves in a front to back direction every time the knock knob 80 is pressed to be operated or the refill 5 is fixed in a predetermined front or rear position. This mechanism has long been known as a mechanism for switching states of a ball point pen between a state in which a tip of a refill projects from its case and a state in which the tip is accommodated in the case and is nothing special or new in mechanism. Thus, a detailed description of the knock mechanism 8 will be omitted here.

Next, the refill 5 according to the embodiment will be described in detail. This refill 5 is a member which enables the whole of the coating film transfer tool 1 to continue to be used without being replaced with a fresh one even after an unused transfer tape 51*a* in the refill 5 has been used up only by replacing the refill 5 with a fresh one.

Figure 3:
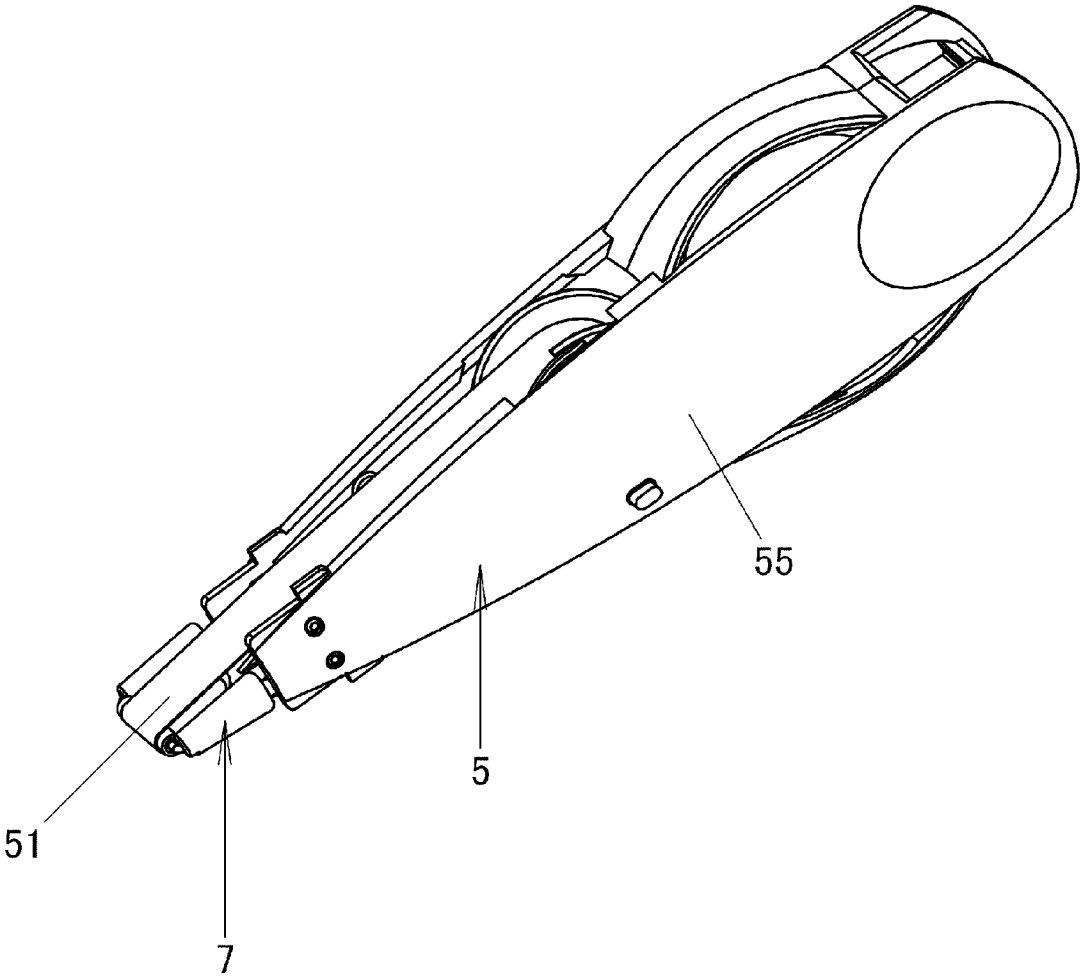
FIG. 3 is a perspective view showing an external appearance of a refill according to the embodiment of the invention.
Figure 4:
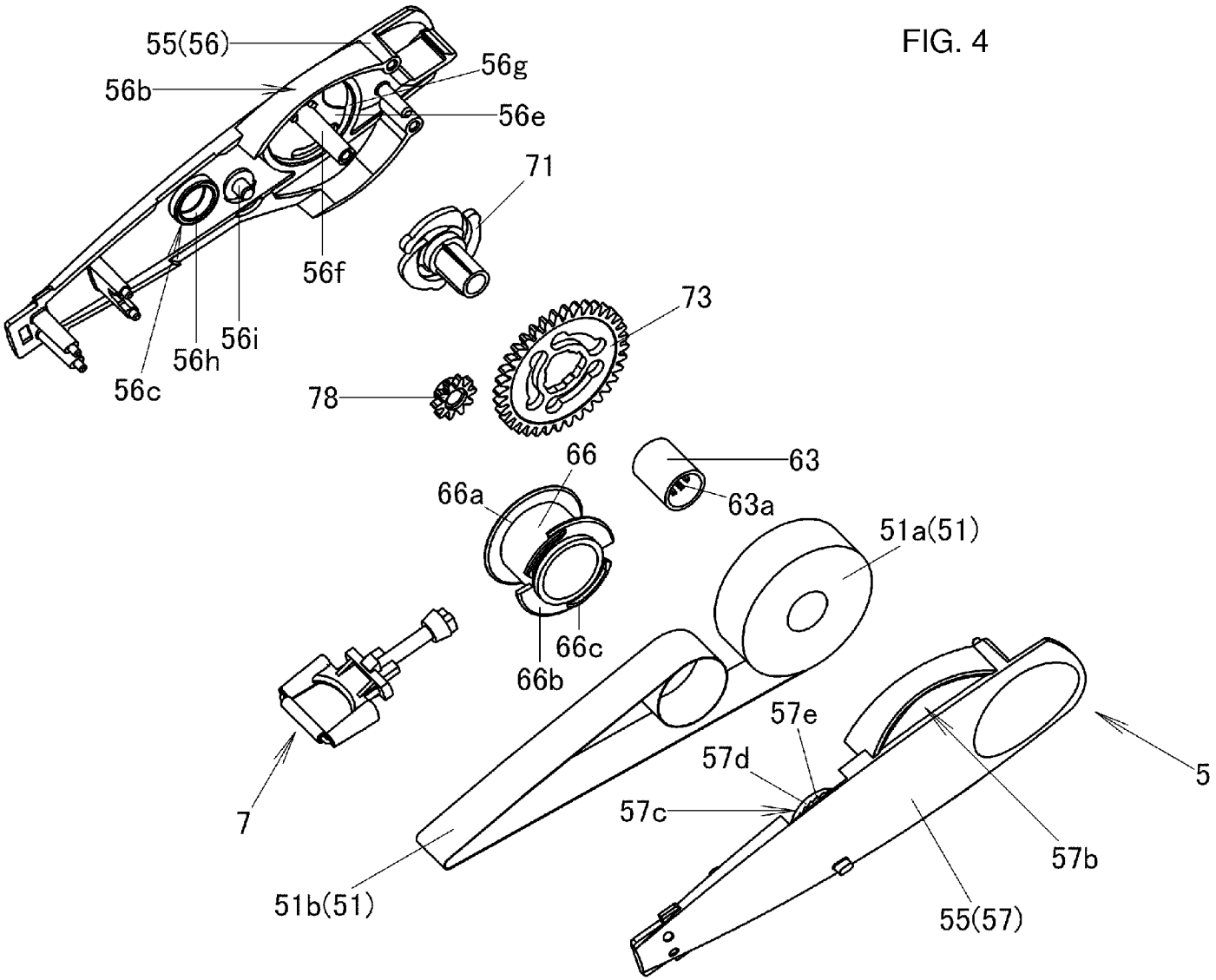
FIG. 4 is an exploded perspective view of the refill.

As is shown in FIGS. 3 and 4, the refill 5 includes a feed spool 63 around which an unused transfer tape 51*a* is wound, the transfer head 7 from which the transfer tape 51 is suspended, a take-up spool 66 around which a used transfer tape 51*b* is wound from which a coating film has already been transferred on to a transfer receiving object, and a transfer portion case 55 which holds constituent components. The refill 5 has a slip member 71 which pivotally supports the feed spool 63 and which is loosely fitted in the transfer portion case 55, a feed-side gear 73 which is fittingly attached to the slip member 71 in a position lying between the feed spool 63 and the slip member 71 and a take-up-side gear which rotates together with the take-up spool 66.

The refill 5 includes a rotation transmission means, a load adjusting means and a rotational speed adjusting means. The rotation transmission means is made up of the slip member 71, the feed-side gear 73 and the take-up-side gear for transmitting a rotation of the feed spool 63 to the take-up spool 66. The load adjusting means is made up of the transfer portion case 55 and the slip member 71 for adjusting a load necessary to feed the unused transfer tape 51*a*. The rotational speed adjusting means is made up of the slip member 71 and the feed-side gear 73 for adjusting rotational speeds of the feed spool 63 and the take-up spool 66.

The transfer head 7 is a member from which the transfer tape 51 is suspended and which pressure transfers a coating film of the transfer tape 51 so suspended to a transfer-receiving object by being caused to slide over the transfer-receiving object while being pressed thereagainst. This transfer head 7 is disposed at a front end of the transfer portion case 55. In addition, the transfer tape 51 is formed by a coating film of a correction tape or a glue tape and a base tape to one side of which the coating film is bonded via a peeling layer. The transfer tape 51 is connected to the feed spool 63 and the take-up spool 66 at ends thereof and is suspended from the transfer head 7.

The transfer portion case 55 is made up of a first case 56 and a second case 57. The first case 56 includes in proximity to a rear end thereof a feed spool holding portion 56*b* in which the feed spool 63 and the slip member 71 are disposed. The first case 56 also includes forwards of the feed spool holding portion 56*b* a take-up spool holding portion 56*c* in which the take-up spool 66 is disposed. The feed spool holding portion 56*b* includes a circular groove 56*e* which is made up of a circular depression which is formed in a flat plate portion thereof and a shaft 56*f* which is formed at a central portion of the circular groove 56*e* so that the feed spool 63 is pivotally attached thereto. A side surface of the circular groove 56*e* is made into an abutment wall 56*g*, and as will be described later, arms 71*g* of the slip member 71 are brought into abutment with this abutment wall 56*g*. Further, the take-up spool holding portion 56*c* includes a cylindrical projecting portion 56*h* which is formed so as to project from the flat plate portion. A shaft 56*i* to which an interlocking gear 78 is pivotally attached is formed between the feed spool holding portion 56*b* and the take-up spool holding portion 56*c*.

The second case 57 includes in proximity to a rear end thereof a feed spool holding portion 57*b* in which the feed spool 63 and the slip member 71 are disposed. The second case 57 also includes forwards of the feed spool holding portion 57*b* a take-up spool holding portion 57*c* in which the take-up spool 66 is disposed. The take-up spool holding portion 57*c* includes a cylindrical projecting portion 57*d* which is formed so as to project from a flat plate portion and a reverse rotation preventive gear 57*e* which has a cylindrical shape which is concentric with the projecting portion 57*d* and which is formed so as to surround a circumferential edge of the projecting portion 57*d*. The reverse rotation preventive gear 57*e* is a member for preventing a reverse rotation of the take-up spool 66. The second case 57 is fixed to the first case 56 in such a state that the members such as the transfer head 7, the feed spool 63 and the take-up spool 66 are held between the first case 56 and itself.

Figure 5:
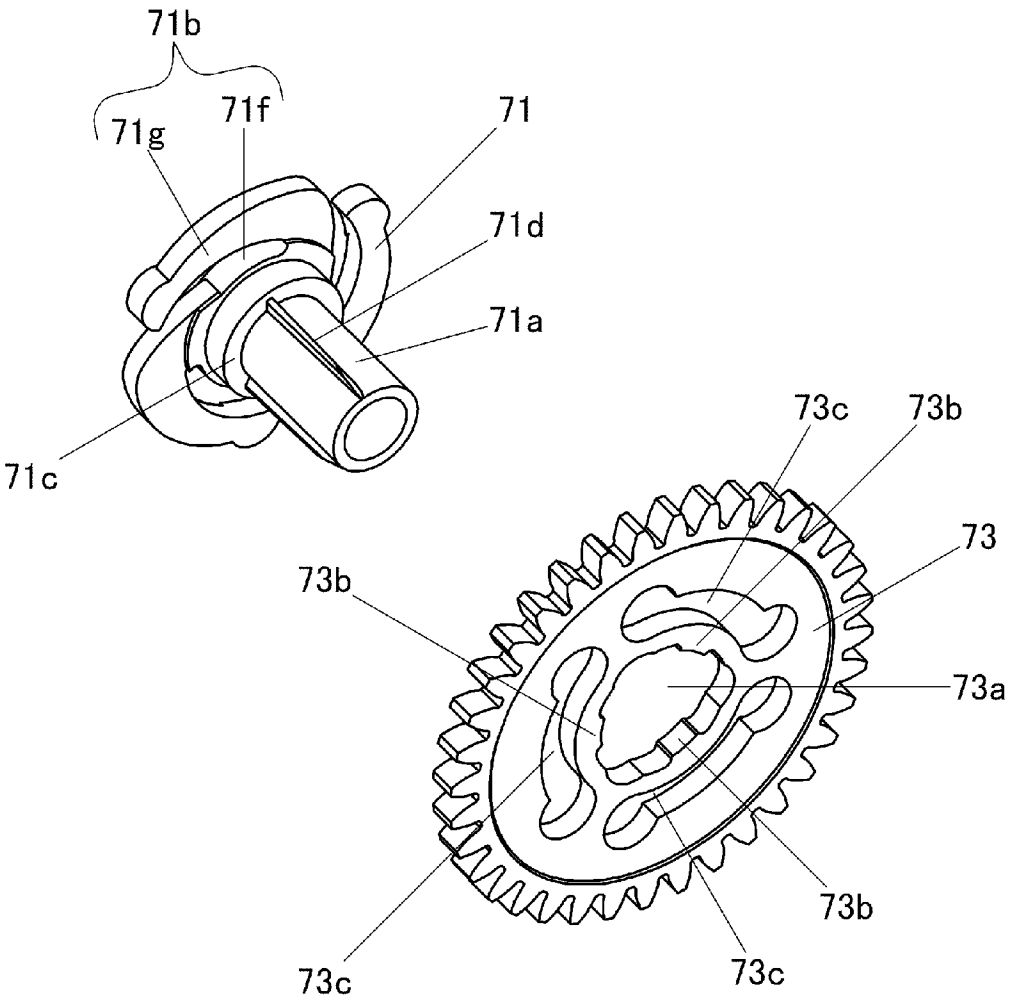
FIG. 5 is an enlarged perspective view showing a slip member and a feed-side gear according to the embodiment of the invention.

As is shown in FIG. 5, the slip member 71 is made up of a cylindrical shaft portion 71*a* which is inserted into an inside of the feed spool 63, an arm portion 71*b* which is formed at a predetermined end portion of the shaft portion 71*a* and a large diameter portion 71*c* which is formed between the shaft portion 71*a* and the arm portion 71*b*. Engagement projections 71*d* are formed on an outer surface of the shaft portion 71*a* so as to be brought into meshing engagement with meshing grooves 63*a* of the feed spool 63. Further, the arm portion 71*b* is made up of a substantially disc-shaped arm base portion 71*f* which projects outwards at one end of the shaft portion 71*a* and the plurality of elastic arms 71*g* which project outwards from an outer surface of the arm base portion 71*f*. The large diameter portion 71*c* is formed so that a shaft diameter thereof is larger than that of the shaft portion 71*a* at a boundary portion between the shaft portion 71*a* and the arm base portion 71*f* of the arm portion 71*b*.

This slip member 71 is pivotally attached to the shaft 56*f* of the first case 56 in such a state that the arm portion 71*b* is inserted into the circular groove 56*e* of the first case 56 and the arms 71*g* are brought into abutment with the abutment wall 56*g*. Then, when the slip member 71 rotates in such a state that the arm portion 71*b* of the slip member 71 is inserted into the circular groove 56*e*, a slip torque is generated between the arms 71*g* and the abutment wall 56*g*, whereby a load is applied to the rotation of the slip member 71. When the load is applied to the rotation of the slip member 71, as will be described later, a load is applied to the rotation of the feed spool 63 which is pivotally mounted on the slip member 71. Thus, a load is applied to the feed of the unused transfer tape 51*a*. Namely, the slip member 71 and the first case 56 function as a load adjusting means.

The feed-side gear 73 is a disc-shaped spur gear which has teeth formed on an outer circumferential edge thereof and a fitting portion 73*a* is formed in a central portion thereof which is a circular opening which is fitted on the large diameter portion 71*c* of the slip member 71. A plurality of abutment projections 73*a* are formed on inner surface of the fitting portion 73*a* at equal intervals so as to project inwards. Elastic openings 73*c* are formed in the feed-side gear 73 between an outer circumferential edge and the fitting portion 73*a*, that is, in proximity to the abutment projections 73*b* in a disc portion thereof as cutouts which extend circumferentially. These elastic openings 73*c* are each formed so that the position where the abutment projection 73*b* is formed constitutes a center position of the elastic opening 73*c* in the circumferential direction. A radius of an inner circumferential edge defined by the plurality of abutment projections 73*b*, that is, a distance from the center of the feed-side gear 73 to the abutment projection 73*b* is formed so as to be slightly smaller than a radius of the large diameter portion 71*c* of the slip member 71.

Figure 6:
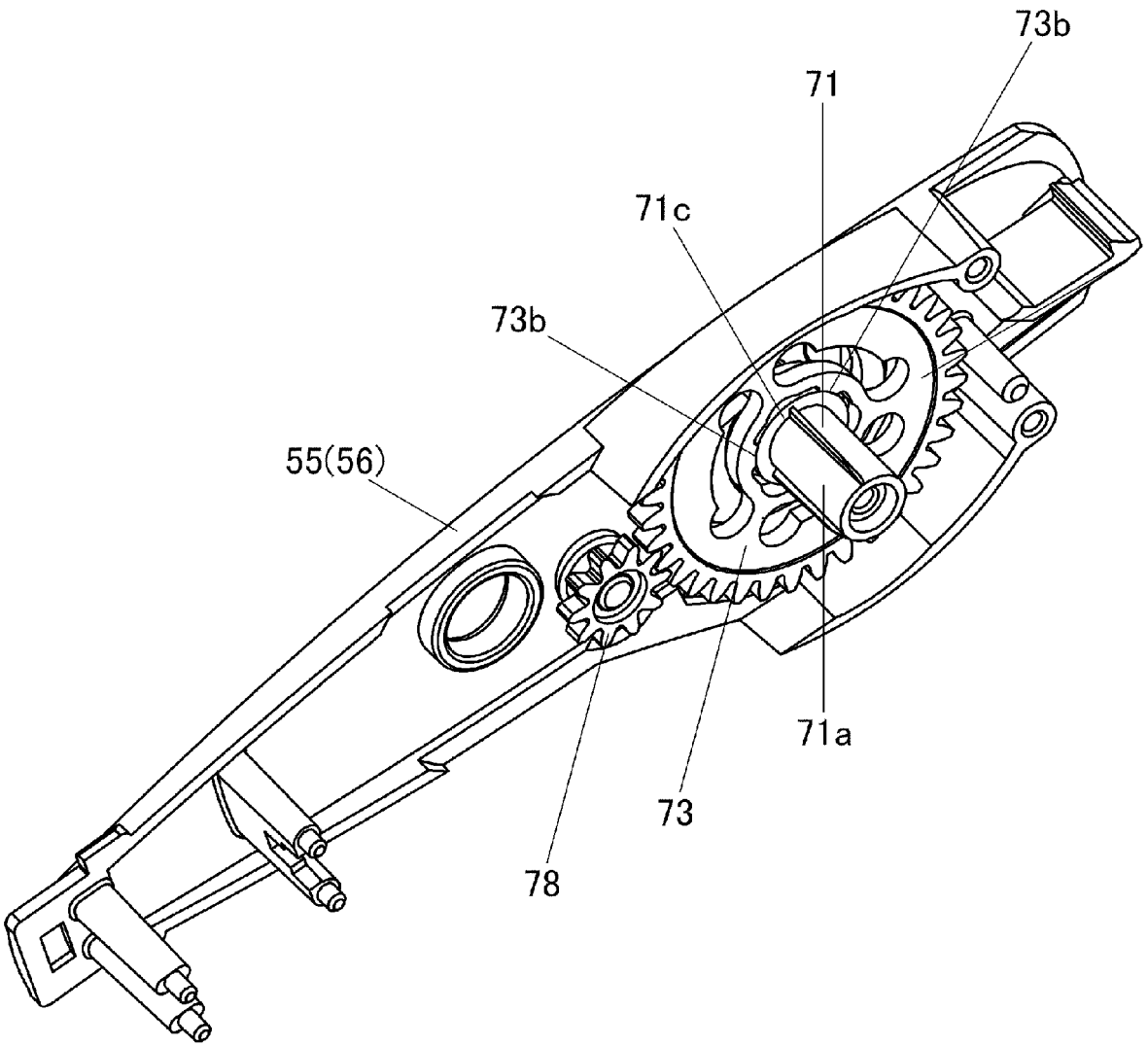
FIG. 6 is a reference perspective view showing a connecting portion between the slip member and the feed-side gear in the refill in an enlarged fashion.

As is shown in FIG. 6, the feed-side gear 73 is securely fitted on the shaft portion 71*a* of the slip member 71 in such a state that the abutment projections 73*b* formed on the fitting portion 73*a* are in abutment with an outer circumferential surface of the large diameter portion 71*c* of the slip member 71. Namely, the feed-side gear 73 is securely fitted on the slip member 71 in such a state that a lateral surface of the large diameter portion 71*c* is held by the abutment projections 73*b*. The teeth formed on the outer circumferential edge of the feed-side gear 73 mesh with those of the interlocking gear 78.

When the slip member 71 rotates in this state, the feed-side gear 73 rotates together with the slip member 71 and the take-up spool 66 shown in FIG. 4 rotates via the interlocking gear 78. Then, when the amount of unused transfer tape 51*a* wound around the feed spool 63 is reduced and a load is applied to the rotation of the feed-side gear 73, the slip member 71 slips within the fitting portion 73*a* in the feed-side gear 73, whereby the rotational speed that is to be transmitted to the take-up spool 66 is adjusted.

Consequently, the feed-side gear 73 functions as the rotation transmission means for transmitting the rotation of the feed spool 63 to the take-up spool 66, and since the slip member 71 can slip, the feed-side gear 73 also functions as the rotational speed adjusting means together in cooperation with the slip member 71. The elastic openings 73*c* are formed so that the portions where the abutment projections 73*c* are formed can elastically be deformed. Namely, the feed-side gear 73 in which the radius of the inner circumferential edge defined by the plurality of abutment projections 73*b* is formed smaller than the radius of the large diameter portion 71*c* of the slip member 71 can securely be fitted on the large diameter portion 71*c* of the slip member 71 by the formation of the elastic openings 73*c*. In addition, although the feed-side gear 73 rotates together with the slip member 71, when a load is applied to the rotation thereof, since the portions where the abutment projections 73*b* are formed are deformed towards the elastic openings 73*c*, the slip member 71 can slip.

In addition, in the coating film transfer tool 1 of the embodiment, a rotational load at the load adjusting means is made larger than a rotational load at the rotational speed adjusting means. Namely, a slip torque working between the slip member 71 and the first case 56 is made larger than a slip torque working between the slip member 71 and the feed-side gear 73. By forming the torque difference between the portions where the slip torques are generated in the way described above, a change in load necessary at the time of transfer of the coating film can be suppressed to a small value, the load sequentially changing from the start of using the coating film transfer tool where the rotational speed of the feed spool 63 is slow towards the end of using the same tool where the rotational speed of the feed spool 63 gets faster. Namely, in the coating film transfer tool 1 of the embodiment, since the load necessary to feed the unused transfer tape 51*a* at the start of using is made large, even in the event that the slip amount controlled by the rotational speed adjusting means increases and a load by the slip is applied, there is caused no such large difference as to be felt by the user, and the user can use the coating film transfer tool while feeling substantially the same sensation.

The feed spool 63 has a cylindrical shape and is opened in both end faces, and the unused transfer tap 51*a* is wound around the feed spool 63. The meshing grooves 63*a* are formed on an inner surface of the feed spool 63 for mesh engagement with the meshing projections 71*d* of the slip member 71. The feed spool 63 is mounted on the shaft portion 71*a* of the slip member 71 in such a state that the feed-side gear 73 is interposed between the slip member 71 and the feed spool 63. The rotation of the feed spool 63 is transmitted to the slip member 71 by mesh engagement of the meshing projections 71*d* on the slip member 71 with the meshing grooves 63*a* in the feed spool 63.

The take-up spool 66 is made up of a cylindrical portion around which the used transfer tape 51*b* is wound, a first disc 66*a* and a second disc 66*b* which are formed so as to project radially outwards from both ends of the cylindrical portion, and the take-up-side gear, not shown, which is formed so as to project downwards from a center of the first disc 66*a*. Formed on the second disc 66*b* is a reverse rotation preventive arm 66*c* which meshes with the reverse rotation preventive gear 57*e* of the second case 57 so as to permit a rotation in one direction but as not to permit a rotation in the other direction.

The take-up spool 66 is pivotally attached to the projecting portion 56*h* which is formed on the feed spool holding portion 56*c* of the first case 56 from the first disc 66*a* side, and a second disc 66*b* side of the take-up spool 66 is pivotally attached to the projecting portion 57*d* which is formed on the take-up spool holding portion 57*c* of the second case 57. In addition, the reverse rotation preventive arm 66*c* of the take-up spool 66 meshes with the reverse rotation preventive gear 57*e* of the second case 57. Further, the take-up-side gear is coupled to the feed-side gear 73 via the interlocking gear 78 and the take-up spool 66 also rotates together with the feed-side gear 73 when the feed-side gear 73 rotates.

The interlocking gear 78 is a spur gear and is pivotally attached to the shaft 56*i* of the first case 56 in such a state that the interlocking gear 78 meshes with the feed-side gear 73 and the take-up-side gear.

In the coating film transfer tool 1 of the embodiment which is configured in the way described heretofore, as has been described above, the rotation transmission means is made up of the slip member 71, the feed-side gear 73, the interlocking gear 78 and the take-up-side gear. Namely, when the feed spool 63 rotates by the transfer tape 51 being fed, the slip member 71 meshing with the feed spool 63 rotates. When the slip member 71 rotates, the feed-side gear 73 pivotally attached to the slip member 71 rotates. When the feed-side gear 73 rotates, the rotation of the feed-side gear 73 is transmitted to the take-up spool 66 by the interlocking gear 78, whereby the take-up spool 66 rotates.

In addition, in the coating film transfer tool 1 of the embodiment, as has been described above, the load adjusting means is made up of the slip member 71 and the first case 56. Namely, when the slip member 71 is mounted on the first case 56, the arm portion 71*b* of the slip member 71 is inserted into the circular groove 56*e* of the first case 56, whereby a slip torque is generated between the elastic arms formed on the arm portion 71*b* and the abutment wall 56*g* of the circular groove 56*e*. Consequently, when the coating film is transferred by the coating film transfer tool 1, a load is applied in feeding the unused transfer tape 51*a*.

Further, in the coating film transfer tool 1 of the embodiment, as has been described above, the rotational speed adjusting means is made up of the slip member 71 and the feed-side gear 73. Namely, since the feed-side gear 73 is securely fitted on the slip member 71 in such a state that the large diameter portion 71*c* of the slip member 71 is held by the abutment projections 73*b* formed on the fitting portion 73*a* therebetween, although the feed-side gear 73 rotates in association with the slip member 71, when a load is applied to the rotation thereof, the portions where the abutment projections 73*b* are formed are elastically deformed towards the elastic openings 73*c*, and the large diameter portion 71*c* of the slip member 71 slips within the fitting portion 73*a*. Consequently, even in the event that the coating film transfer tool 1 is used in such a state that the amount of the unused transfer tape 51*a* which is wound around the feed spool 63 is reduced, since the feed spool 63 and the take-up spool 66 rotate with a difference in rotational speed which differs from that at the start of using the coating film transfer tool 1, a phenomenon can be prevented in which the feed of the unused transfer tape 51*a* is made difficult.

In addition, in the conventional coating film transfer tool, many components are necessary to configure the rotation transmission means, the load adjusting means and the rotational speed adjusting means, and the increase in the number of components constitutes the problem. However, in the coating film transfer tool 1 of the embodiment, since the slip member 71 functions as the component which configures the rotation transmission means, the load adjusting means and the rotational speed adjusting means, the coating film transfer tool 1 can be provided which can reduces the number of components while having the rotation transition means, the load adjusting means and the rotational speed adjusting means.

In the embodiment that has been described heretofore, although the configuration is adopted in which the replaceable refill 5 has the rotation transmission means, the load adjusting means and the rotational speed adjusting means, even in the event that the invention is applied to a coating film transfer tool in which refills cannot be replaced, that is, a throw-away type coating film transfer tool, the object and advantage of the embodiment can be attained by a similar configuration. Namely, a first case 56 and a second case 57 of a refill 5 are made to make up a main body case of a throw-away type coating film transfer tool which incorporates therein a similar configuration.

In addition, in the embodiment, although the invention is described as being applied to the knock-type coating film transfer tool 1, the invention is not limited thereto, and a similar configuration can be adopted in a coating film transfer tool of every type in which refills are replaceable. Namely, the invention is not limited to the embodiment that has been described above but can freely be modified or improved without departing from the spirit and scope of the invention.

INDUSTRIAL APPLICABILITY

According to the coating film transfer tool of the embodiment, the coating film transfer tool can be provided which can reduce the number of components while having the load adjusting means and the rotational speed adjusting means, which has a high degree of freedom in design and which is easy to be used.

What is claimed is:

1. A coating film transfer tool comprising:

a feed spool around which an unused transfer tape is wound;

a transfer head from which the transfer tape is suspended and which pressure transfers a coating film on the transfer tape suspended therefrom to a transfer-receiving object by pressing the coating film thereagainst;

a take-up spool around which the transfer tape is wound after the coating film is transferred;

a rotation transmitting means for transmitting a rotation of the feed spool to the take-up spool;

a transfer portion case configured to hold the feed spool, the take-up spool and the rotation transmitting means;

a slip member which pivotally supports the feed spool and which is loosely fitted in the transfer portion case;

a feed-side gear securely fitted on the slip member in a position lying between the feed spool and the slip member; and a take-up-side gear which rotates together with the take-up spool, wherein the slip member has a shaft portion to which the feed spool is pivotally attached, an arm portion including an arm base portion formed in proximity to one end of the shaft portion and a plurality of arms that project outwards from the arm base portion, and a large diameter portion that is positioned at a boundary portion between the shaft portion and the arm base portion and has a shaft diameter that is larger than a diameter of the shaft portion, wherein the feed-side gear is a disc-shaped gearwheel in which teeth are formed along an outer circumferential edge and an opening is formed in a central portion as a fitting portion and has a plurality of abutment projections formed on an inner circumferential edge of the fitting portion for abutment with the large diameter portion of the slip member and an elastic opening that is provided as a circumferentially extending cutout in proximity to the position where the abutment projections are formed, wherein the transfer portion case includes a circular abutment wall that is centered around the shaft portion to which the feed spool is pivotally attached and with which arms of the slip member are brought into abutment, wherein a rotation of the feed spool is transmitted to the take-up spool by the gears, and wherein the transfer portion case and the slip member configures a load adjusting means that generates a slip torque between the arms and the abutment wall, and the slip member and the feed-side gear configures a rotational speed adjusting means for causing the feed spool to slip by virtue of the abutment projections which abut with the large diameter portion of the slip member so that the whole rotation of the feed spool is not transmitted to the take-up spool.

2. A coating film transfer tool as set forth in claim 1, comprising further:

a main body case; and a refill which is detachably accommodated within the main body case, wherein the transfer portion case is made to function as a case for the refill, wherein the refill incorporates therein the feed spool, the transfer head, the take-up spool, the rotation transmitting means, the slip member and the feed-side gear, and wherein the refill includes the load adjusting means and the rotational speed adjusting means.

* * * * *